United States Patent [19]

Silvestri, Jr.

[11] Patent Number: 4,527,396

[45] Date of Patent: Jul. 9, 1985

[54] MOISTURE SEPARATING DEVICE

[75] Inventor: George J. Silvestri, Jr., Maitland, Fla.

[73] Assignee: Westinghouse Electric Corp., Pittsburgh, Pa.

[21] Appl. No.: 535,135

[22] Filed: Sep. 23, 1983

[51] Int. Cl.[3] ..... F01K 17/00

[52] U.S. Cl. ..... 60/685; 60/657; 55/457

[58] Field of Search ..... 55/452, 457, 461; 60/685, 694, 646, 657

[56] References Cited

U.S. PATENT DOCUMENTS

| | | | |
|---|---|---|---|
| 3,320,729 | 5/1967 | Stahl | 55/461 |
| 3,902,876 | 9/1975 | Moen et al. | 55/457 X |
| 4,268,277 | 5/1981 | Rooker | 55/452 X |
| 4,355,515 | 10/1982 | Cohen et al. | 60/657 |

FOREIGN PATENT DOCUMENTS

| | | | |
|---|---|---|---|
| 2357308 | 3/1978 | France | 55/457 |

*Primary Examiner*—Stephen F. Husar

*Attorney, Agent, or Firm*—Fred J. Baehr, Jr.

[57] ABSTRACT

A moisture separator which incorporates an inner cylinder disposed in coaxial relation with an exhaust pipe of a steam turbine utilizes the spiral secondary flow of a gas stream to remove liquids which are entrained therein. The moisture separator incorporates an inner cylinder which has one or more apertures through its wall. The inner cylinder is placed in coaxial relation with the exhaust pipe of a steam turbine with means for sealing the axial ends of an annular chamber formed between the cylinder and the exhaust pipe. Means are provided for dividing the annular chamber into a plurality of arcuate spaces and for removing liquid which collects within each of the arcuate spaces. The moisture separator utilizes the characteristic of gas streams which creates spiral secondary flows when forced to turn around a bend. The spiral flows cause liquid, which is entrained in a gas stream, to migrate to the inner surface of a pipe or cylinder and coalesce on the walls thereof. The moisture separator utilizes these characteristics of turning streams of gas in order to separate liquid from a moisture-laden gas stream.

10 Claims, 10 Drawing Figures

MOISTURE SEPARATING DEVICE

BACKGROUND AND SUMMARY OF THE INVENTION

The present invention relates generally to an apparatus for removing a liquid from a gas stream and, more particularly, to the separation of water from a stream of high pressure steam flowing through an exhaust pipe of a high pressure steam turbine.

When a liquid is entrained in a gaseous stream, droplets of that liquid can cause severe erosion within the pipes which carry the gas at high velocities. In a steam generator system, the problem of pipe erosion is most commonly seen within the pipes which connect the high pressure turbine exhaust to a moisture separator reheater. Within these pipes, erosion is generally most pronounced in the extraction pipes that are joined to crossunder pipes just below the high pressure turbine exhaust snouts. The erosion of crossunder piping is therefore a serious concern to electrical utilities. When pipe erosion causes minor damage, it requires periodic weld repair, mostly in the form of cladding with an erosion resistant material, but, in more severe cases, patches have to be added to the outer surface of the eroded pipes.

Pipe erosion can be significantly reduced by reducing the amount of entrained moisture in the stream of high pressure steam flowing out of the exhaust snout of the turbine. If entrained moisture is removed from the exhaust steam of the turbine, two important advantages can be realized. The erosion damage to downstream piping can be significantly reduced and the efficiency of the moisture separator reheater can be improved.

When a fluid flows through a bend in a pipe, centrifugal forces tend to cause the fluid to be forced to the outside wall of the bend. However, although these centrifugal forces exist, a secondary flow of fluid occurs within pipe bends and has a significant effect on the behavior of liquid entrained within the gas stream. It is known to those skilled in the art that the stream lines of a fluid flowing through a bend in a pipe will not be parallel to the center line of that pipe. Instead, the fluid assumes a spiral path as it traverses the bend and this spiral path, when viewed in cross section, actually comprises a pair of spirals which exist side by side on opposing sides of a center line of the pipe which is parallel to the plane of the bend. These twin spirals cause the flow within the pipe bend to flow along the walls of the pipe toward the inside of the bend and then pass through the center portion of the pipe towards the outside of the bend. The direction of flow within this pair of spirals also determines the movement of an entrained liquid within the gas stream and, therefore, determines the specific locations where potential erosion can occur.

The existence of the pair of spirals within a gas stream flowing through a pipe bend and its affect on the flow of moisture within the gas stream can be used in a beneficial way to separate a portion of the moisture from a moisture-laden stream of gas. An apparatus for removing liquid from a liquid-laden gas stream which utilizes the above-described flow phenomenon is described in U.S. Pat. No. 3,320,729 which issued to Stahl on May 23, 1967. The Stahl patent disposes a perforated plate at the inner region of a pipe bend and provides conduits for removing liquid which passes into a chamber described by the perforated plate. It utilizes the spiral flow phenomenon which exists when a stream of gas flows through a pipe bend in such a way so as to deposit a significant quantity of its moisture along the inner radius of the bend.

It has been determined that, in a high pressure steam turbine, the flow of steam within the steam turbine is directed along the path which is somewhat analogous to that of gas flowing through a pipe bend. The turning of the stream of steam within the high pressure turbine occurs prior to its passage into its exhaust snout and, eventually, through the crossunder piping which connects the high pressure turbine to a moisture separator reheater. However, the flow of steam from a high pressure turbine is much more complex than the more predictable flow of a gas through a simple pipe bend. Therefore, the precise deposition of liquid within the exhaust pipe of a high pressure turbine cannot be as easily predicted as in the case of a pipe bend. Although the inner contours of a high pressure turbine cause the steam to be turned at several locations, the turning of the stream of steam is not simple or constant as in the case of a pipe bend having a constant radius.

The present invention incorporates a tube, or cylinder, disposed within the exhaust pipe of a high pressure turbine. The cylinder is disposed in coaxial relation with the exhaust pipe and supported within the pipe in such a way that exhaust steam which leaves the high pressure turbine passes through the internal bore of the cylinder.

The cylinder, or tube, is provided with a plurality of apertures through its wall and the relative diametric sizes of the exhaust pipe and the cylinder are such that their coaxial association describes an annular chamber, or space, between them. The apertures of the cylinder permit fluid communication between the internal portion of the cylinder and the annular chamber. This annular chamber is sealed at its axial ends in order to prevent a flow of liquid from leaving the annular chamber in an axial direction and possibly being reentrained within the stream of gas passing through the cylinder. A conduit is utilized to provide a means for removing a liquid from the annular chamber through the wall of the pipe.

In order to minimize the possibility of disadvantageous flows of liquid within the annular chamber, a preferred embodiment of the present invention includes at least two barriers connected between the cylinder and the pipe within the region of the annular chamber. These barriers extend in a direction which is generally parallel to the center line of the pipe and divide the annular chamber into at least two distinct arcuate spaces. The barriers prevent a liquid from passing from one of these spaces into the other. Each of the spaces within the annular chamber is provided with a conduit for removing its collected liquid through the wall of the pipe.

As the exhaust steam from a high pressure turbine element passes through the internal portion of the cylinder, which is disposed in coaxial relation with the high pressure steam turbine's exhaust pipe, any secondary flow spirals which exist within the cylinder will cause the moisture which is entrained within the gas stream to flow along the walls of the cylinder and pass through the apertures. After passing through the apertures, the liquid then is collected within the arcuate spaces of the annular chamber and can then be removed from the annular chamber through the conduits which pass through the walls of the pipe. After this moisture is removed, the remaining portion of the gas stream is allowed to continue through the cylinder and, eventually, through the crossunder piping which connects the high pressure steam turbine exhaust snout with the moisture separator reheater. Since the gas stream passing through the crossunder piping has had a portion of its moisture removed by the present invention, potential erosion damage to downstream piping components will be significantly reduced and the efficiency of the moisture separator reheater will be enhanced.

BRIEF DESCRIPTION OF THE DRAWINGS

The present invention will be more clearly understood from the following description of the preferred embodiment read in connection with the accompanying drawing in which.

DESCRIPTION OF THE PREFERRED EMBODIMENT

The present invention relates generally to a moisture separating device and, more particularly, to an apparatus for removing water from a flow of steam as it leaves the exhaust snout of a high pressure turbine.

Figure 1:
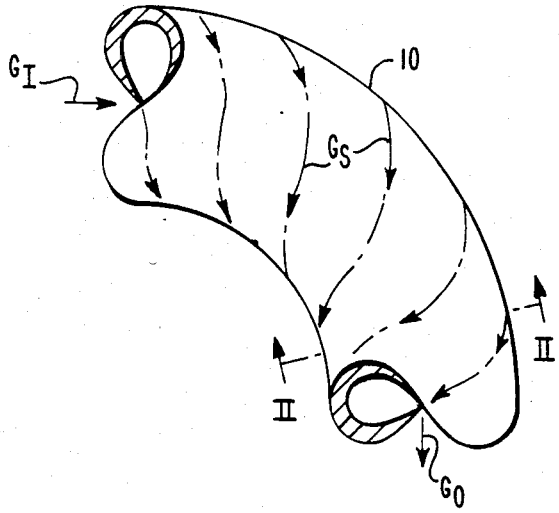
FIG. 1 shows an exemplary pipe bend and the streamlines of a flow of fluid therethrough.

As a gas stream passes through a bend in a pipe, it changes direction and exhibits a flow which follows a path that is not parallel with the center line of the pipe. FIG. 1 illustrates a pipe bend 10 through which a flow of gas is passing. As a gas, such as steam, approaches a pipe bend, as illustrated by arrows $G_I$, it is generally parallel to the center line of the pipe. However, as the gas flows around the bend of the pipe 10 it begins to exhibit a spiral flow as indicated by arrows $G_S$. After leaving the bend region of the pipe, the gas stream eventually returns to a path which is generally parallel to the center line of the pipe. It should be understood, however, that this normalization of flow of the gas leaving the pipe bend, as illustrated by arrows $G_O$, does not immediately take place as it leaves the pipe bend. Instead, the flow of gas retains its spiral shape for a distance after it leaves the region of the pipe bend. The specific distance along which the gas stream retains its spiral flow is a function of the gas velocity, pipe size, radius of the pipe bend and other physical characteristics and conditions.

Figure 2:
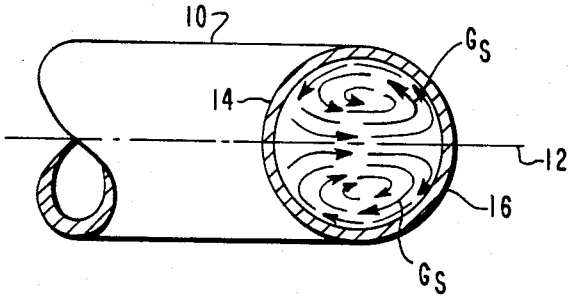
FIG. 2 is a sectional view of the pipe bend of FIG. 1.

FIG. 2 is a sectional view of the pipe bend 10 illustrated in FIG. 1. In FIG. 2, the twin spirals indicated by arrows $G_S$ can be seen flowing on opposite sides of a center line 12 of the pipe bend 10 which is generally parallel to the plane of the bend. As can be seen in FIG. 2, this spiral flow proceeds along the wall of the pipe as it passes toward the inside 14 of the bend and it then passes along the center line 12 of the pipe as it proceeds towards the outside 16 of the bend.

Figure 3:
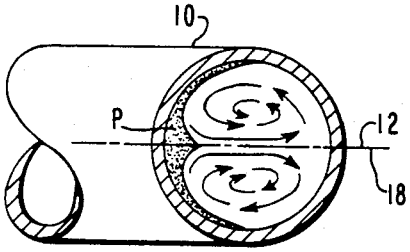
FIGS. 3, 4 and 5 illustrate the typical behavior of a liquid within a gas stream flowing through a pipe bend under various conditions.
Figure 4:
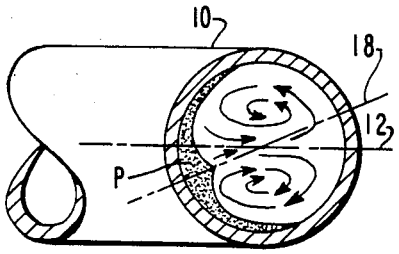
Figure 5:
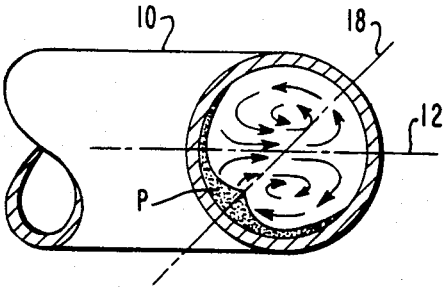

FIGS. 3, 4 and 5 illustrate the effect that the twin spiral flow has on a liquid which is entrained within the gas stream. It should be apparent that the twin spirals will tend to cause a liquid to move along the walls of the pipe as it passes through a pipe bend and eventually meet at a stagnation point P where the two spirals are causing liquid to move in opposing directions toward each other. In FIGS. 3, 4 and 5, this stagnation point P is shown at various positions along the wall of the pipe which are determined by the relative magnitudes of the gas velocity and the acceleration of gravity. For example, FIG. 3 illustrates the circumstance where the gas is moving through the pipe at a velocity of approximately 300 ft/sec and with a Froude number of approximately 17,000. The stagnation point P, where the collects against the wall of the pipe, lies essentially on the pipe's center line 12 which lies within the plane of the bend. A center line 18 which passes through the center of the pipe and the stagnation point P is therefore essentially coincident with the center line 12. FIG. 4 illustrates a condition where the gas is flowing at a lesser rate of speed of approximately 150 ft/sec with a Froude number of approximately 4,250. As can be seen, the stagnation point P in FIG. 4 lies below the center line 12 due to the increased relative effect of gravity as compared to the effect of the gas velocity. Under these conditions, center line 12 and center line 18 diverge as the stagnation point P moves away from the extreme inside portion of the bend (reference numeral 14 in FIG. 2). In FIG. 5, the velocity of the gas is approximately 50 ft/sec with a Froude number of approximately 470. As can be seen, the stagnation point P has moved significantly away from the center line 12 and center line 18 has diverged significantly from the center line 12 due to the increased relative magnitude of gravity as compared to the gas velocity.

As can be seen from FIGS. 3, 4 and 5, the twin spirals of flow within a pipe bend 10 cause a stagnation point P to be formed where moisture which exists in the gas flow can be forced to collect. As is further illustrated by these figures, the exact location of the stagnation point P can vary within the pipe bend as a function of the gas velocity and the direction of the gravitational force on the fluid relative to the position of the pipe bend. In FIGS. 3, 4 and 5, the pipe bend 10 is illustrated as lying in a horizontal plane with the pipe's center line 12, which is generally parallel to the plane of the bend, being horizontal. It should be apparent that the positioning of the pipe bend in alternative directions relative to the direction of gravitational force will significantly affect the location of the stagnation point in relationship to the twin spirals of gas flow and the inside portion 14 of the pipe bend.

Figure 6:
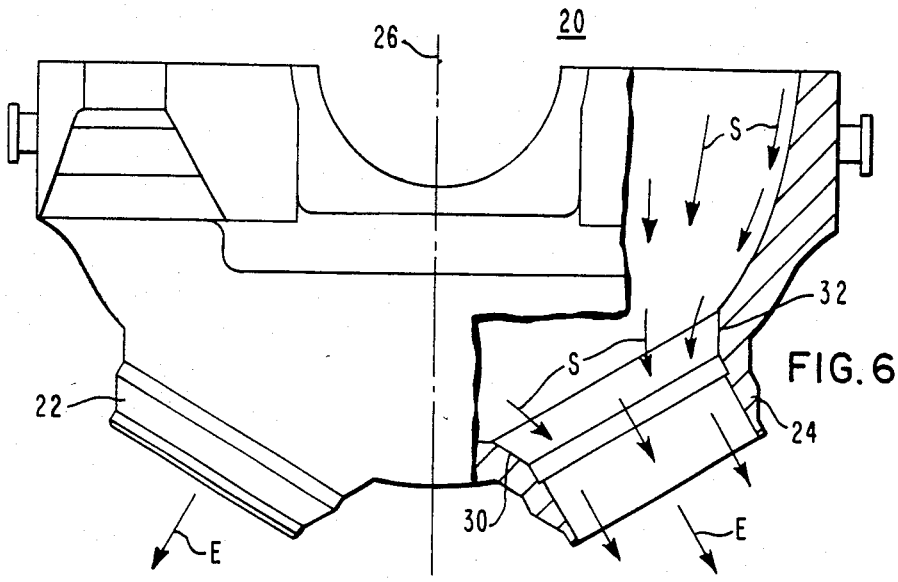
FIG. 6 illustrates an end view of the exhaust portion of a high pressure steam turbine.

FIG. 6 illustrates the exhaust portion of a high pressure steam turbine 20 with two steam exhaust snouts, 22 and 24. FIG. 6 illustrates a high pressure steam turbine 20 which is generally symmetrical about its center line 26. The internal region of the turbine 20 which is proximate the exhaust snout 24 is shown in sectioned view in order to more clearly illustrate the typical path of high pressure steam as it approaches the exhaust snout 24. A portion of the flow of steam within the steam turbine 20 is illustrated by arrows S. Most of the entering flow follows the outside contour of the shell as illustrated by arrows S. Because of the placement of the exhaust snouts, 22 and 24, and the approaching flow indicated by arrows S, the flow distribution into an exhaust pipe (not illustrated in FIG. 6) connected to an exhaust snout 24 of a steam turbine will be skewed and there will therefore be higher rates of turning or change in direction at some positions within the snouts than at others. When a flow of gas is caused to bend, turn or changes direction, the flow at the inner radius of the bend will have a higher rate of turning than at the outer radius of the bend. The magnitude of secondary flow, which comprises twin spirals as discussed above, varies directly with the rate of turning of the fluid.

As can be seen in FIG. 6, there are two regions, 30 and 32, which are analogous to pipe bends where the flow of steam is caused to make a sharper turn than at other regions in the vicinity of the snout 24. The flow of steam around region 32 is especially pronounced because the flow of steam in that particular region is forced to make a turn which is somewhat sharper than that flow in the region 30. The reason for this, in the particular exemplary design illustrated in FIG. 6, is that a significant portion of the steam which is passing toward the snout 24 from the center line 26 region of the turbine can flow in a relatively straight path across the center line 26, whereas the steam flowing downward past region 32 is forced to make a more radical turn or change in direction in order to enter the snout 24. It would therefore be expected that the steam flowing around region 32 will develop more significant twin spirals of secondary flow as illustrated in FIGS. 2, 3, 4 and 5. The exact location and direction of the spiral secondary flow will depend on the specific physical configuration of the turbine exhaust snout, the velocity of the high pressure steam, the relative affects of gravity and drag, the effects of adjacent flows of steam and various other physical variables. As the steam exits from the snouts, 22 and 24, it will continue this spiral secondary flow as it passes in the general direction illustrated by arrows E through the exhaust piping toward the moisture separator reheaters.

Figure 7:
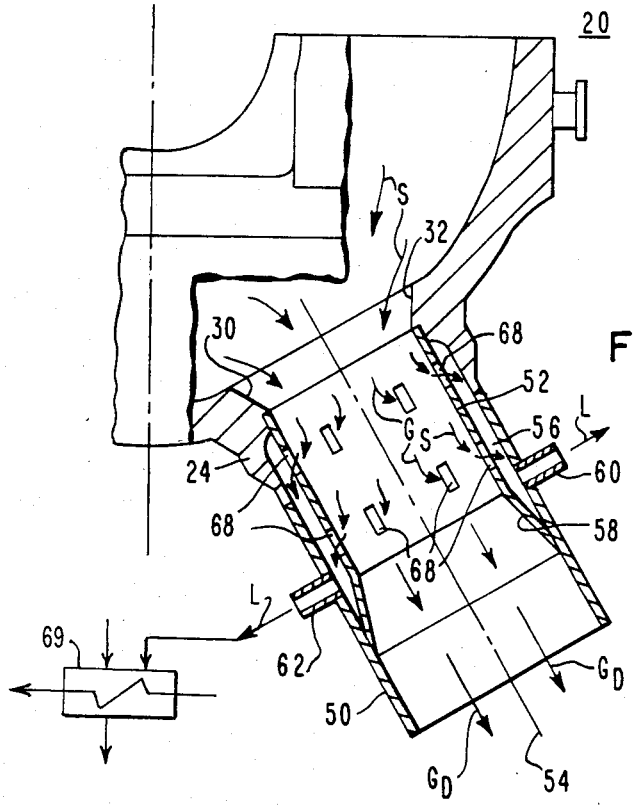
FIG. 7 shows the present invention attached to the exhaust pipe of a steam turbine.

FIG. 7 illustrates a portion of the steam turbine 20, which is illustrated in FIG. 6, with the present invention attached to the exhaust snout 24. As the steam, as illustrated by arrows S, passes the region 32, it is turned at a more radical rate than at other regions in the vicinity of the snout 24. This turning causes the formation of the spiral flow of the gas as described above. The spiral flow is indicated by arrows $G_S$ as it exits from the region of the snout 24. It should be understood that the spiral flow pattern illustrated by arrows $G_S$ is exemplary, for purposes of illustrating the present invention, and is not intended to be an exact representation of the gas flow as it leaves the snout 24. The precise shape of the stream lines of the gas flow exiting the high pressure steam turbine will vary from case to case as a function of the physical parameters of the steam flow and the shape of the exit portion of the steam turbine 20.

Connected to the snout 24 of the steam turbine 20 is an exhaust pipe 50 which extends away from the turbine 20 and is intended to conduct a flow of high pressure steam from the turbine 20 to a moisture separator reheater (not shown in FIG. 7). It should be understood that, even in steam turbine applications which do not employ the present invention, an exhaust pipe 50 would typically be connected in fluid communication with the snout 24 for these purposes.

The present invention incorporates a cylinder 52, or tube, which is disposed in coaxial relation with the exhaust pipe 50. Both the pipe 50 and the cylinder 52 are generally symmetrical about center line 54. The cylinder 52 and the pipe 50 are chosen to have diametric sizes which, when assembled, describe an annular chamber 56 between them. The present invention also incorporates a means for sealing the axial ends of this annular chamber 56. In FIG. 7, this sealing means incorporates a conical member 58 which is connected to both the pipe 50 and the cylinder 52 as shown. This conical sealing means prevents a fluid from flowing out of the annular chamber 56 in an axial direction which would permit it to reenter, and be reentrained into, the gas stream. The conical member 58 is disposed at the downstream end of the cylinder 52 and annular chamber 56. The upstream end of the annular chamber 56 is effectively sealed by the presence of the snout 24. In the specific embodiment illustrated in FIG. 7, the diameters of the pipe 50 and cylinder 52 cooperate with the thickness of the snout 24 in such a way that the mouth of the snout 24 provides a means for sealing the upstream end of the annular chamber 56.

One or more means of removing a fluid from the annular chamber in a direction away from the pipe 50 are provided by the present invention. In FIG. 7, these removing means are illustrated by conduits, 60 and 62, which provide fluid communication between the annular chamber 56 and a region outside of the pipe 50. As illustrated in FIG. 7, these conduits, 60 and 62, pass through the walls of the pipe 50. The purpose of these conduits, 60 and 62, is to permit the removal of liquid from the annular chamber 56.

The cylinder 52 is provided with at least one means for providing fluid communication between the annular chamber 56 and the region within the cylinder 52. In FIG. 7, this fluid communication is provided by a plurality of apertures 68 in the wall of the cylinder 52. These apertures 68 permit a fluid, such as water, to pass in a radially outward direction from the internal portion of the cylinder 52 into the annular chamber 56. The spiral secondary flow of the steam, as it passes through the cylinder 52, causes the entrained water to be forced against the inside walls of the cylinder 52, as described above and illustrated in FIGS. 3, 4 and 5. As the liquid is forced against the inside walls of the cylinder 52, it can pass through the apertures 68 into the annular chamber 56. From the annular chamber 56, the fluid can be removed through the conduits, 60 and 62. In normal practice, the fluid which is removed from the conduits, 60 and 62, would be directed to one of a plurality of feedwater heaters 69, shown schematically in FIG. 7, which are used to raise the temperature of feedwater passing to a steam generator of the steam turbine system. After a portion of its entrained moisture is removed from the gas stream, the dry steam passes out of the present invention as illustrated by arrows $G_D$ in a direction towards a moisture separator reheater (not shown in FIG. 7). The drier steam passing from the present invention will have a markedly reduced tendency to cause pipe erosion in the crossunder piping which connects the turbine 20 to the moisture separator reheater.

Figure 8:
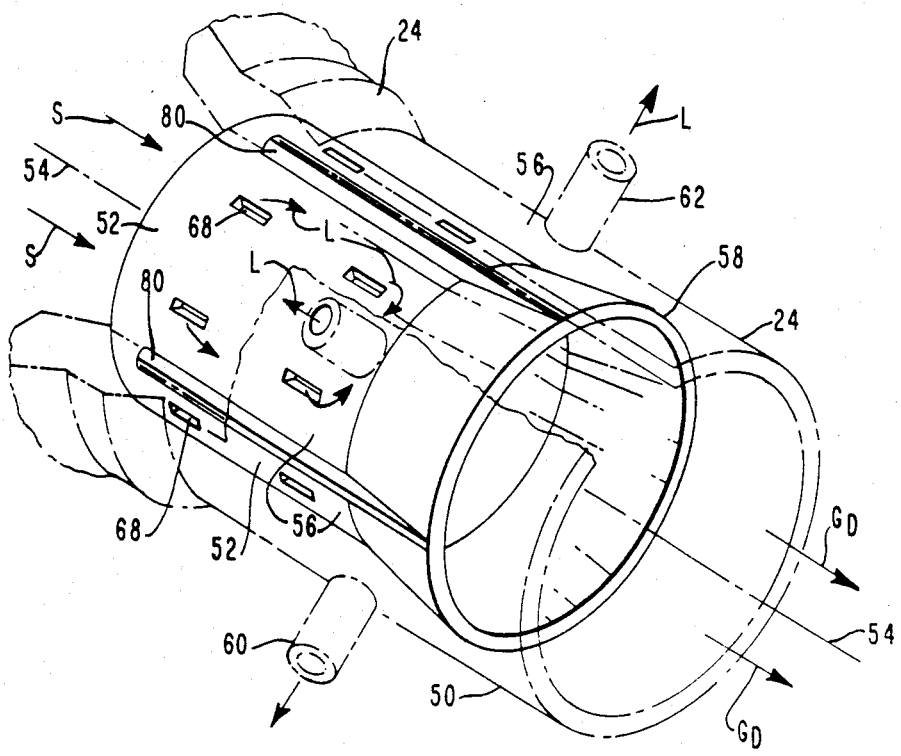
FIG. 8 illustrates a more detailed view of the present invention.

FIG. 8 illustrates a more detailed view of the present invention. In FIG. 8, the present invention is illustrated as it would be disposed within an exhaust pipe 50 which is shown in phantom representation in order to more clearly illustrate the primary components of the present invention. The exhaust pipe 50 is similar to the one shown in FIG. 7 and one end of the pipe 50 is connected to a snout 24 of a steam turbine. The cylinder 52, or tube, of the present invention is shown in FIG. 8 as having a plurality of apertures 68 passing through its wall. The apertures 68 allows a fluid to pass through the wall of the cylinder 52 in a radial direction. A conical member 58 is used as a means for sealing one axial end of the annular chamber 56 which is formed between the outer surface of the cylinder 52 and the inner surface of the pipe 50. The conical member 58 has a generally conical bore through its center and its smaller end is connected to the cylinder 52 while its larger end is connected to the pipe 50. When attached to both the pipe 50 and the cylinder 52 in this manner, the conical member 58 prevents a passage of liquid out of the annular chamber 56 in an axial direction where it could otherwise be reentrained within the gas stream.

The embodiment of the present invention which is illustrated in FIG. 8 incorporates a plurality of barriers 80 which are connected to both the cylinder 52 and the pipe 50. The barriers 80 extend in an axial direction which is generally parallel to the center line 54 of both the pipe 50 and the cylinder 52. These barriers 80 act to subdivide the annular chamber 56 into a plurality of arcuate spaces which are not in direct fluid communication with each other. The primary function of these barriers 80 is to prevent the liquid which enters the annular chamber 56 from flowing around the outer surface of the cylinder 52 in such a way so as to make its collection and removal more difficult. It should be understood that, when barriers 80 are utilized in conjunction with the present invention, each arcuate space formed by the barriers must have a conduit, such as 60 and 62, in fluid communication with it.

As the steam, indicated by arrows S, passes through the snout 24 and into the cylinder 52 of the present invention, it will tend to form twin spirals $G_S$ of secondary flow because of the fact that it had been turned at a fairly radical rate by the internal shape of the steam turbine and the snout upstream from the cylinder 52. This secondary flow, which is discussed above, causes entrained liquids within the gas stream to be forced against the internal surface of the walls of the cylinder 52. The presence of the apertures 68 allows the liquid to pass through the walls of the cylinder 52 in a radially outward direction as illustrated by arrows L. The liquid then enters the annular chamber 56 where it can collect and pass through the conduits, 60 and 62, as illustrated by arrows L. After passing through the present invention in an axial direction, dry steam, as indicated by arrows $G_D$, can then continue through the pipe 50 and flow towards the moisture separator reheaters of a typical steam turbine system.

It should be understood that the present invention, as illustrated in FIG. 8, can have apertures 68 and barriers 80 disposed at particular locations which will facilitate the collection of liquid that is removed from the flow of steam which is exiting from a steam turbine. In particular applications, it may be found to be advantageous to concentrate the apertures 68 on one side of the cylinder 52 with the barriers 80 cooperatively disposed to concentrate the flow of liquid within the annular chamber 56. In other applications, where the spiral flow is not precisely predictable, the apertures 68 can be distributed in a generally uniform manner around the cylinder 52 with a higher number of barriers 80 used in conjunction with them.

Figure 9:
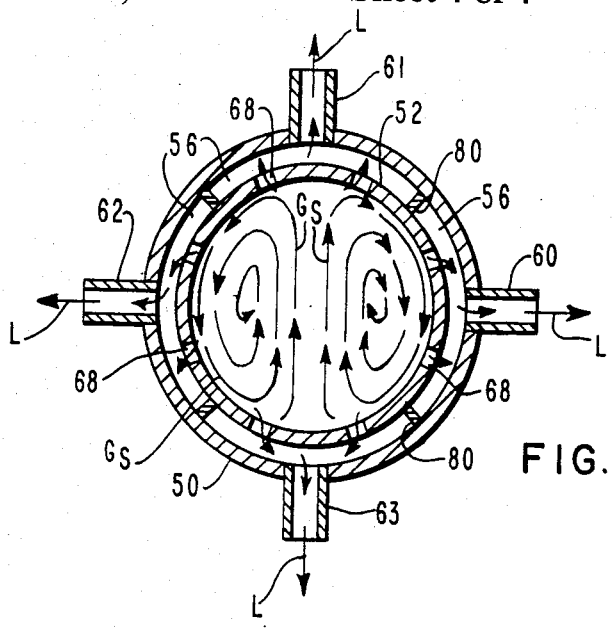
FIG. 9 shows a cross-section view of the present invention.

FIG. 9 illustrates a cross section view of the present invention. As can be seen from this illustration, the cylinder 52 of the present invention is provided with a plurality of apertures 68 through its wall. The cylinder 52 is disposed in coaxial relation with an exhaust pipe 50 of a steam turbine. The diametric sizes of the pipe 50 and the cylinder 52 are chosen so as to describe an annular chamber 56 when they are associated coaxially. A plurality of barriers 80 are connected between the pipe 50 and the cylinder 52 so as to subdivide the annular chamber 56 into a plurality of arcuate spaces. Each of the arcuate spaces of the annular chamber 56 is provided with a means for removing a liquid therefrom. In FIG. 9, these liquid removing means are illustrated as conduits, 60–63, which pass through the wall of the pipe 50 and provide fluid communication between the annular chamber 56 and a region outside of the pipe 50. In typical steam turbine system applications, the conduits, 60–63, would be connected in fluid communication with a feedwater heater which would utilize the liquid which is removed from the annular chamber 56 to raise the temperature of feedwater as it passes toward a steam generator.

As indicated by arrows $G_S$, a gas flowing axially through the cylinder 52 will have a spiral-shaped secondary flow if, prior to entering the cylinder 52 of the present invention, it passes through a region which requires a radical turning of its stream. This secondary flow, illustrated by arrows $G_S$, tends to cause entrained liquids within the gas stream to be forced outwardly toward the inner surface of the cylinder wall. As this liquid is forced in a radially outward direction against the wall, it can pass through the apertures 68 of the cylinder 52 and enter the arcuate spaces of the annular chamber 56. The water will then collect within these arcuate spaces and subsequently pass out of the pipe 50 through the conduits, 60–63. After having its entrained moisture thus removed, the dry steam can continue to pass axially through the cylinder 52 of the present invention and, eventually, through crossunder piping into a moisture separator reheater.

Figure 10:
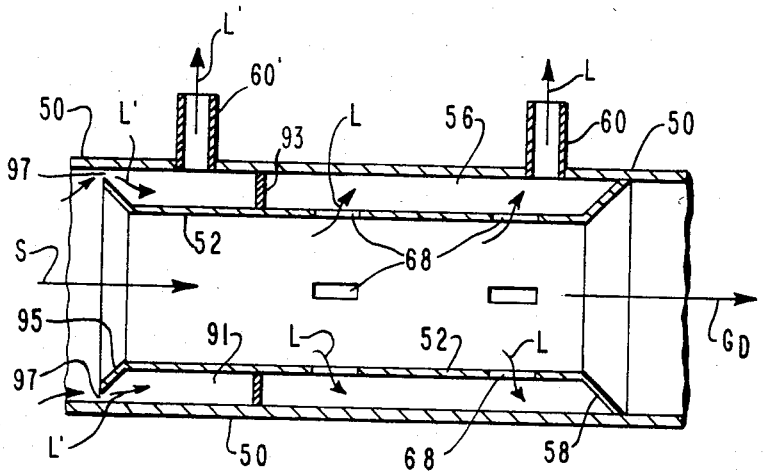
FIG. 10 illustrates an alternative embodiment of the present invention.

An alternative embodiment of the present invention is illustrated in FIG. 10. It is similar in most respects to the preferred embodiment described above, but has an additional chamber 91 located in an upstream direction from the annular chambers 56. As in the preferred embodiment described above, the moisture separating device illustrated in FIG. 10 comprises a pipe 50 which has a cylinder 52 disposed within it in coaxial and concentric relation. The cylinder 52 also has a conical member 58 connected between it and the pipe 50 in such a way so as to prevent the passage of liquid out of the annular chambers 56 in a direction parallel to the center line of the pipe 50. The cylinder 52 has a plurality of apertures 68 through which entrained moisture can pass in a radially outward direction from the internal portion of the cylinder 52 into the annular chamber 56. Furthermore, a conduit 60 is provided in order to permit the liquid to pass out of the annular chamber 56. This passage of liquid is illustrated by arrows L.

The apparatus in FIG. 10 differs from the apparatus illustrated in FIGS. 7 and 8 by the inclusion of a conical member 95 connected to the upstream portion of the cylinder 52 in such a way so as to describe a gap 97 between the larger diameter of the conical member 95 and the internal surface of the pipe 50. Furthermore, a barrier 93 is provided which separates the annular chamber 56 from an upstream chamber 91.

Comparing FIGS. 7 and 10, it should be apparent that the barrier 93 serves the same purpose as the snout 24 in FIG. 7. This purpose is to prevent a migration of trapped liquids from the annular chamber 56 in a direction parallel to the center line of the pipe 50. In other words, once a liquid enters the annular chamber 56, its only means of leaving the annular chamber 56 is through the conduit 60 or a similar conduit which provides fluid communication between the annular chamber 56 and a device external to the pipe 50.

The purpose of the cylinder extension 52' and the conical member 95 is to provide an upstream chamber into which liquid, indicated by arrows L', can enter and be removed from the pipe 50. In some cases, due to condensation within a steam turbine, liquid can be caused to flow along the internal walls of the steam turbine and pipe 50. When this liquid flow occurs, the embodiment of the present invention which is illustrated in FIG. 10 immediately removes that flowing liquid from the stream of steam, indicated by arrow S, and from the internal portion of the cylinder 52. This liquid, which is illustrated by L', flows along the internal surface of the pipe wall and into the chamber 91. It then is removed from the chamber 91 through conduit 60'.

The alternative embodiment illustrated in FIG. 10 removes moisture from a flow of steam in a two step procedure. As the steam, indicated by arrow S, enters the upstream portion of the present invention, the liquid which is not entrained in its flow passes along the internal wall of the pipe 50 and through the gap 97 which exists between the internal surface of the pipe 50 and the conical member 95. After passing through the gap 97, the liquid enters the chamber 91 and eventually exits from the chamber 91 through the conduit 60'. This liquid flow is indicated by arrows L'. Other moisture, which is entrained in the flow of steam, passes through the internal bore of the conical member 95 and into the cylinder 52. Because of the spiral flow discussed above, the entrained moisture is forced against the internal surface of the cylinder 52 and a significant portion of this moisture passes through the aperture 68 into the annular chamber 56. This flow of liquid, indicated by arrows L, then passes from the annular chamber 56 through the conduit 60 and away from the pipe 50. After the removal of the entrained moisture, the dry steam which is indicated by arrow $G_D$ passes through the bore of the conical member 58 and continues through the pipe 50.

It should be understood that the alternative embodiment illustrated in FIG. 10 is similar in most respects to the preferred embodiment of the present invention which is illustrated in FIGS. 7, 8 and 9. The difference between these two embodiments is the addition of a cylinder extension 52' along with a conical member 95 which combine to form an annular chamber 91 which is in fluid communication, through gap 97, with the upstream region within the pipe 50. The annular chamber 91 is disposed upstream from the annular chamber 56 and as these two annular chambers are separated by a barrier 93.

After having its moisture removed by the present invention, steam which exits from a steam turbine can pass through appropriate piping toward a moisture separator reheater with a reduced risk of causing pipe erosion due to entrained moisture in its gas stream. By removing moisture from this stream of gas, such as steam, the present invention reduces potential erosion damage to piping and increases the efficiency of moisture separator reheaters.

Although the preferred embodiment of the present invention has been described in considerable detail and illustrated with specificity, it should be understood that other alternative embodiments are also to be considered within its scope.

What I claim is:

1. An apparatus for removing moisture from a moisture laden stream of gas flowing in a pipe, comprising:

a cylinder having an outer diameter which is smaller than the inner diameter of said pipe;

means for supporting said cylinder generally inside said pipe in generally coaxial association with said pipe, said generally coaxial association forming an annular space between said cylinder and said pipe;

means for preventing fluid flow from said annular space to said pipe in a direction which is generally parallel to said stream of gas;

means for removing a fluid from said annular space in a direction away from said pipe;

means for permitting a fluid to flow from said cylinder into said annular space;

a plurality of axially aligned longitudinal barriers generally extending the length of said annular space dividing said annular space into a plurality of separately enclosed arcuate segments each of which has fluid removing means in fluid communication therewith and has means for permitting fluid to flow from said cylinder cooperatively associated therewith; and said apparatus being disposed in said pipe downstream of a change in the direction of said stream of gas whereby moisture is separated from said gas stream and is removed from said pipe by said apparatus.

2. The apparatus of claim 1, wherein:

said preventing means comprises a conical tube having first and second axial ends, said first axial end having a diameter which is generally equal to the diameter of said cylinder, said second axial end having a diameter which is generally equal to the diameter of said pipe, said first end being connected to said cylinder and said second end being connected to said pipe.

3. The apparatus of claim 1, wherein:

said removing means is a fluid conduit passing through said pipe in fluid communication with said annular space.

4. The apparatus of claim 1, wherein:

said permitting means are apertures in the wall of said cylinder, said apertures providing fluid communication between the inner portion of said cylinder and said segments of said annular space.

5. A steam turbine, comprising:

a steam exhaust pipe defining a fluid passage;

a tube disposed generally within said pipe in coaxial relation therewith, said tube having an outside diameter which is smaller than the inside diameter of said pipe, said tube and said pipe defining a first annular chamber between them;

means for supporting said tube within said pipe;

means for permitting a fluid to flow from inside said tube into said first annular chamber;

means for removing said fluid from said first annular chamber through the wall of said pipe;

means for sealing the axial ends of said first annular chamber;

an extension of said tube connected to said tube in such a manner that the axes are aligned;

a generally conical member connected to said extension, said conical member extending away from said axis, said conical member and said pipe being cooperatively associated to define an annular gap therebetween, said conical member, extension and pipe being cooperatively associated to define a second annular chamber, in fluid communication with said annular gap; and means for providing fluid communication between said second annular chamber and region external to said pipe.

6. The steam turbine of claim 5, wherein:

said permitting means is an aperture in the wall of said tube.

7. The steam turbine of claim 5, wherein:

said sealing means comprises a conical member connected between said tube and said pipe, said conical member having a central bore therethrough.

8. The steam turbine of claim 5, further comprising:

a plurality of barriers disposed in said annular chamber between said tube and said pipe, said barriers being aligned in a parallel association with the centerline of said pipe, said barriers forming a plurality of subchambers within said annular chamber.

9. The steam turbine of claim 5, wherein:

said removing means is a conduit passing through the wall of said pipe in fluid communication with said annular chamber.

10. The steam turbine of claim 5, wherein:

said removing means is connected in fluid communication with a heat exchanger.

* * * * *